US010183490B2

(12) United States Patent
Sato et al.

(10) Patent No.: US 10,183,490 B2
(45) Date of Patent: Jan. 22, 2019

(54) LIQUID DISCHARGE HEAD

(71) Applicant: CANON KABUSHIKI KAISHA, Tokyo (JP)

(72) Inventors: Tomohiro Sato, Tokyo (JP); Shintaro Kasai, Yokohama (JP); Yoshiyuki Nakagawa, Kawasaki (JP); Akiko Saito, Tokyo (JP); Takatsugu Moriya, Tokyo (JP); Koichi Ishida, Tokyo (JP); Tatsuya Yamada, Kawasaki (JP); Shuzo Iwanaga, Kawasaki (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/691,402

(22) Filed: Aug. 30, 2017

(65) Prior Publication Data

US 2018/0056654 A1 Mar. 1, 2018

(30) Foreign Application Priority Data

Sep. 1, 2016 (JP) ..... 2016-170768

(51) Int. Cl.
*B41J 2/14* (2006.01)
*B41J 2/145* (2006.01)

(52) U.S. Cl.
CPC ..... *B41J 2/1433* (2013.01); *B41J 2/1404* (2013.01); *B41J 2/145* (2013.01); *B41J 2/14233* (2013.01)

(58) Field of Classification Search
CPC .... B41J 2/1433; B41J 2/14233; B41J 2/1404; B41J 2/145
See application file for complete search history.

(56) References Cited

U.S. PATENT DOCUMENTS

2010/0079544 A1* 4/2010 Sumi ..... B41J 2/0452 347/40

FOREIGN PATENT DOCUMENTS

JP 2010-83026 A 4/2010

* cited by examiner

*Primary Examiner* — Sharon A Polk
(74) *Attorney, Agent, or Firm* — Canon U.S.A., Inc. IP Division

(57) ABSTRACT

A discharge port array is inclined to a second direction B at an angle θ that satisfies a relation of tan θ=d2/(N×d1), where d1 is a distance between discharge ports within the discharge port array in the second direction B, and d2 is a distance between two adjacent discharge ports within each group in a first direction.

11 Claims, 10 Drawing Sheets

LIQUID DISCHARGE HEAD

BACKGROUND OF THE INVENTION

Field of the Invention

The present disclosure relates to a liquid discharge head that discharges liquid from a discharge port.

Description of the Related Art

A recording device for recording an image on a recording medium by discharging liquid such as ink includes a liquid discharge head that discharges the liquid from a plurality of discharge ports. In the liquid discharge head, pressure is generated inside a pressure chamber in which the liquid is stored, and the liquid inside the pressure chamber is discharged by the pressure from the discharge port formed on one end of the pressure chamber. It is known that crosstalk occurs in such a discharge liquid head. The pressure generated in the pressure chamber fluctuates when the liquid is discharged, and the pressure fluctuation interferes with other pressure chambers. Such a phenomenon is called the crosstalk. If the crosstalk occurs, discharge of the liquid becomes unstable at a discharge port that has undergone the interference due to the pressure fluctuation of another discharge port, causing density unevenness in a recorded image. This may degrade image quality. The influence of the crosstalk is more significant if a plurality of discharge ports is two-dimensionally arranged at high density in a liquid discharge head to enhance image quality.

A method for reducing the influence of the crosstalk includes shifts in discharge timings of the plurality of discharge ports. However, the discharge timing shifts may cause misalignment of a liquid landing position in a conveyance direction of the recording medium, and thus image quality may be degraded. In view of the issue, Japanese Patent. Application Laid-Open No. 2010-83026 discusses a configuration of a liquid discharge head including a plurality of two-dimensionally arranged discharge ports and capable of reducing influence of crosstalk, while taking misalignment of a liquid landing position into consideration. According to the configuration, a discharge port array communicating with a common liquid supply path is divided into a plurality of locks, and liquid is discharged at a different timing on a block basis. Meanwhile, arrangement of the discharge ports is adjusted on a block basis according to a discharge timing shift.

However, in the configuration discussed in Japanese Patent Application Laid-Open No. 2010-83026, since a discharge timing is shifted on a block basis, a reduction effect of the influence of crosstalk may not be enough.

SUMMARY OF THE INVENTION

The present disclosure is directed to liquid discharge head that reduces influence of crosstalk provide higher image quality.

According to the present disclosure, a liquid discharge head that discharges liquid to a recording medium conveyed in a first direction includes a recording element board including a plurality of discharge ports for discharging liquid, a plurality of pressure chambers communicating with the plurality of discharge ports, respectively, and each including thereinside an energy generating element configured to generate energy to be used for discharging liquid, and a common supply path communicating with the plurality of pressure chambers and configured to supply liquid to the plurality of pressure chambers.

According to one aspect of the present disclosure, the plurality of discharge ports forms a discharge port array arrayed in an inclined manner with respect to a second direction perpendicular to the first direction, the adjacent pressure chambers in an array direction of the discharge port array communicate with each other via only the common supply path, the plurality of discharge ports is divided into N number of groups ($N \geq 2$), each of the groups includes a plurality of discharge ports arranged every Nth discharge port, and the N number of groups sequentially perform liquid discharge operations on a group basis according to time division in such a manner that each of a plurality of discharge ports belonging to a same group discharges liquid at a same time and a plurality of discharge ports belonging to different groups successively discharges liquid in array order, and the discharge port array is inclined to the second direction by an angle θ that satisfies a relation of $\tan\theta = d2/(N \times d1)$, where d1 is a distance between discharge ports within the discharge port array in the second direction, and d2 is a distance between two adjacent discharge ports within each of the groups in the first direction.

According to another aspect of the present disclosure, the plurality of discharge ports forms a plurality of parallel discharge port arrays arrayed in an inclined manner with respect to a second direction perpendicular to the first direction, at least some of M number of successive pressure chambers ($M \geq 2$) in an array direction of each of the discharge port arrays communicate with each other, the plurality of discharge ports is divided into N number of groups ($N \geq 2$), each of the groups includes a plurality of discharge ports arranged every Nth discharge port in same discharge port array and a plurality of discharge ports arranged at same positions in the second direction in different discharge port arrays, and the N number of groups sequentially perform liquid discharge operations on a group basis according to time division in such a manner that a plurality of discharge ports belonging to a same group in a same discharge port array discharges liquid at a same time and plurality of discharge ports belonging to different groups in different discharge port arrays successively discharges liquid, the plurality of discharge ports forms at least M number of the discharge port arrays if N is equal to or larger than M ($N \geq M$), and forms at least N number of the discharge port arrays if M is larger than N ($M > N$), and each of the discharge port arrays is inclined to the second direction by an angle θ that satisfies a relation of $\tan\theta = d2/(N \times d1)$, where d1 is a distance between discharge ports within each of the discharge port arrays in the second direction, and d2 is a distance between two adjacent discharge ports within each of the groups in the first direction.

In the above liquid discharge head, the liquid discharge operation is performed according to time division for every N number of groups each including a plurality of discharge ports arranged every Nth discharge port, so that influence by crosstalk can be reduced. Moreover, since the discharge port array is inclined to a direction (the second direction) perpendicular to a conveyance direction of a recording medium at an inclination angle θ corresponding to the number of time divisions (the N number of groups), misalignment of a landing position due to time divisional driving can be cancelled, and image quality degradation can be reduced.

Further features of the present disclosure will become apparent from the following description of exemplary embodiments with reference to the attached drawings.

DESCRIPTION OF THE EMBODIMENTS

Exemplary embodiments of the present disclosure are described with reference to the drawings.

A liquid discharge head 1 according to a first exemplary embodiment is described with reference to FIGS. 1 to 5.

Figure 1:
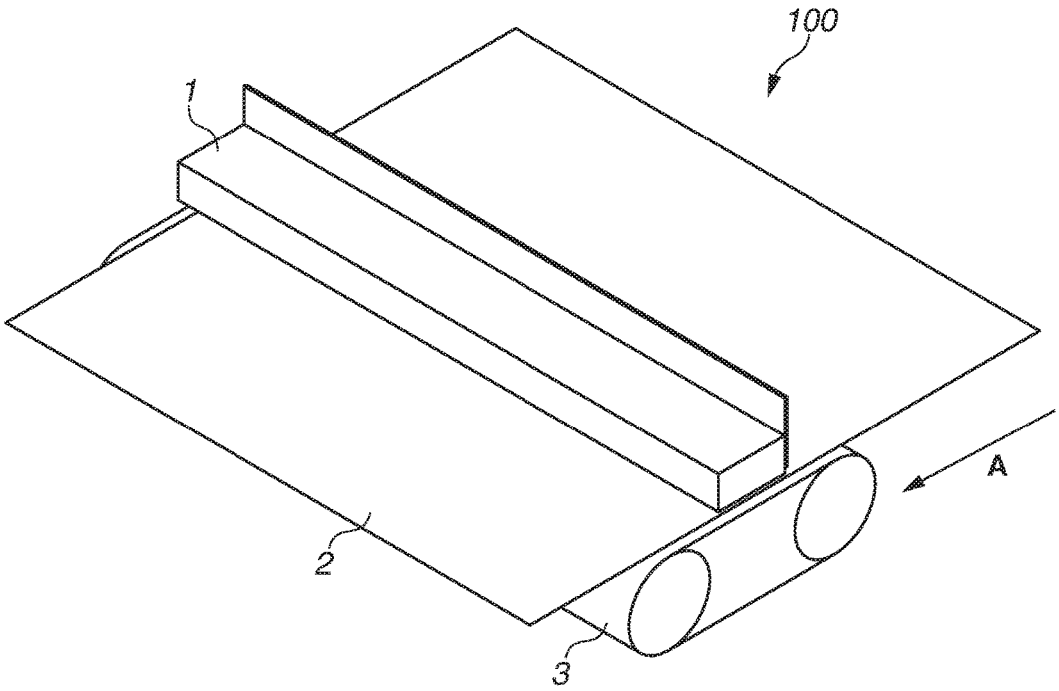
FIG. 1 is a schematic perspective view illustrating a liquid discharge apparatus according to a first exemplary embodiment.

FIG. 1 is a schematic perspective view of a recording device 100 on which a liquid discharge head 1 according to the present exemplary embodiment is mounted. A configuration of the recording device illustrated in FIG. 1 is one example, and the present exemplary embodiment is not limited thereto.

The recording device 100 illustrated in FIG. 1 includes the liquid discharge head 1 of a full line system, and employs one-pass system to record an image on a recording medium 2 with one conveyance of the recording medium 2. The liquid discharge head 1 of the full line system includes a plurality of discharge ports arranged across the entire width direction of the recording medium 2 as described below, and liquid such as ink is discharged from the discharge ports to the recording medium 2 conveyed in a direction indicated by an arrow A shown in FIG. 1 by a conveyance unit 3 to record an image.

Figure 2:
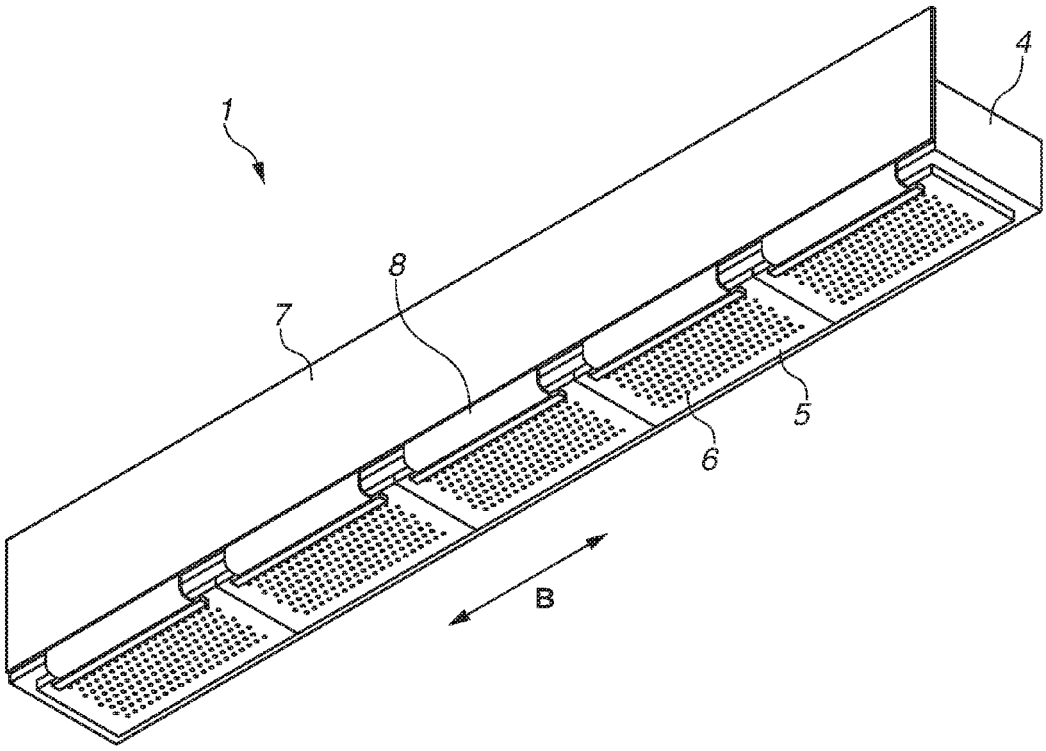
FIG. 2 is a schematic perspective view illustrating a liquid discharge head according to the first exemplary embodiment.

FIG. 2 is a schematic perspective view of the liquid discharge head 1 of the present exemplary embodiment. A configuration of the liquid discharge head 1 illustrated in FIG. 2 is one example, and the present exemplary embodiment is not limited thereto.

The liquid discharge head 1 includes a plurality of recording element boards 5 attached to a casing 4. The plurality of recording element boards 5 is arranged side y side in a line in a direction indicated by an arrow B (hereinbelow called "a head longitudinal direction") perpendicular to the conveyance direction A of the recording medium 2. Each of the recording element boards 5 includes a plurality of discharge ports 6. Accordingly, the plurality of discharge ports 6 is arranged across the entire width direction of the recording medium 2. Each of the recording element boards 5 is connected to an electric wiring board 7 by a flexible wiring board 8. The electric wiring board 7 is used to supply power or signals necessary for discharging liquid from the discharge ports 6. The recording element board 5 receives liquid supplied from a liquid container (not illustrated) via a common supply port (not illustrated) arranged in the casing 4, and the liquid supplied to the recording element board 5 is discharged from the discharge port 6 through a pressure chamber and a common supply path of the recording element board 5. The pressure chamber and the common supply path will be described below.

Figure 3A:
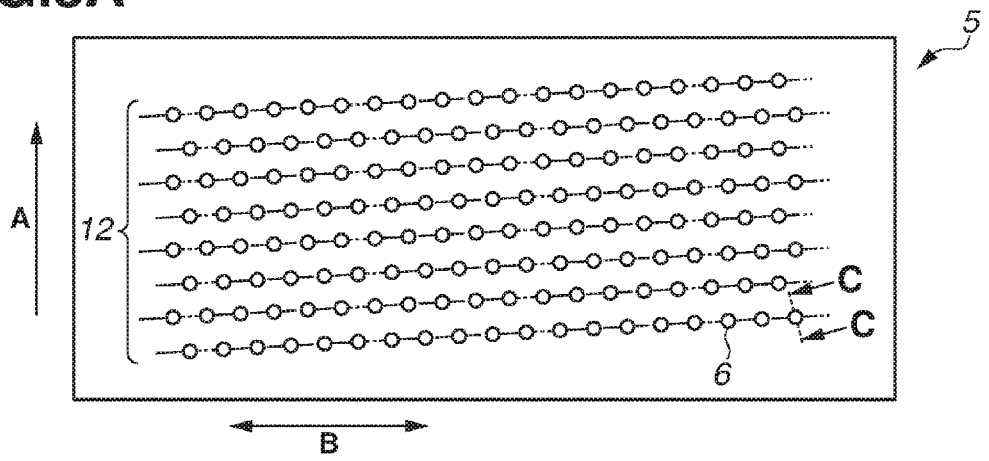
FIG. 3A is a schematic plan view illustrating a recording element board according to the first exemplary embodiment.
Figure 3B:
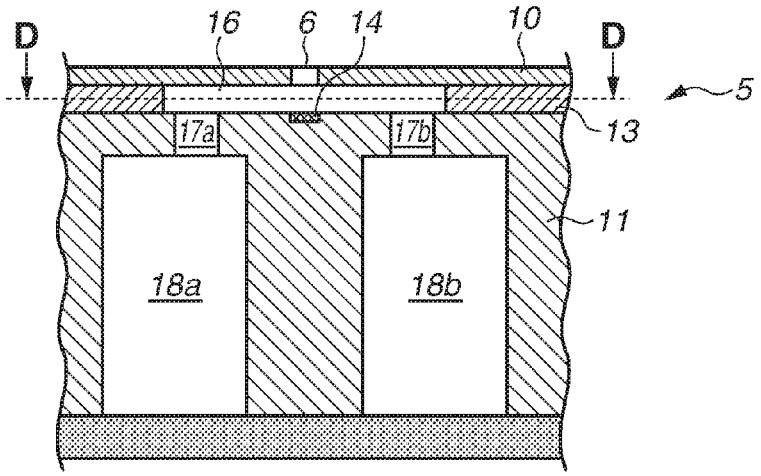
FIGS. 3B and 3C are schematic sectional views each illustrating the recording element board.
Figure 3C:
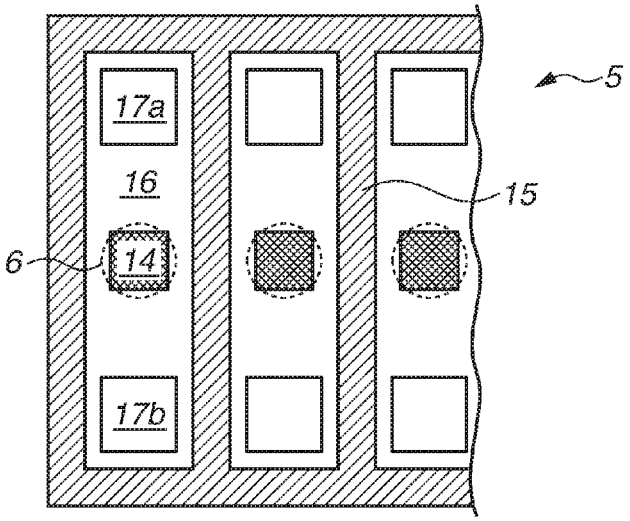

FIG. 3A is a schematic plan view of the recording element board 5 according to the present exemplary embodiment. FIG. 3B is a sectional view along the line C-C of FIG. 3A, and FIG. 3C is a sectional view along the line D-D of FIG. 3B.

As illustrated in FIG. 3A, the recording element board 5 includes a plurality of discharge port arrays 12 each including the plurality of discharge ports 6. Each of the discharge port arrays 12 is arrayed in an inclined manner with respect to a head longitudinal direction (a second direction) B perpendicular to the conveyance direction (a first direction) A, and such discharge port arrays 12 are arranged parallel to each other along the conveyance direction A. The plurality of discharge port arrays 12 is arranged in such a manner that positions of the discharge ports 6 in the head longitudinal direction B are substantially the same in every other array.

Moreover, as illustrated in FIG. 3B, the recording element board 5 includes a board 11, flow path forming member 13 bonded to the board 11, and a discharge port forming member 10 bonded to the flow path forming member 13. The discharge port 6 is formed in the discharge port forming member 10, and a pressure chamber 16 communicating with the discharge port 6 is formed in the flow path forming member 13. An energy generating element 14 serving as a heating element that generates energy to be used for discharging liquid is arranged in position opposite the discharge port 6 inside the pressure chamber 16. Such heat energy enables the liquid inside the pressure chamber 16 to generate bubbles and then be discharged from the discharge port 6. An example of the energy generating element 14 may include a piezoelectric element that causes pressure to be generated inside a pressure chamber by deformation to discharge liquid. As illustrated in FIG. 3C, the pressure chamber 16 is completely partitioned off from an adjacent pressure chamber 16 by a partition 15, and communicates with the discharge port 6 on a one-to-one basis.

Moreover, as illustrated in FIG. 3B, common supply paths 18*a* and 18*b* that supply liquid to the pressure chamber 16 are formed on the board 11. The common supply paths 18*a* and 18*b* are common to the plurality of pressure chambers 16 of one discharge port array 12, and extend along an array direction of the discharge port array 12. The common supply paths 18*a* and 18*b* separately communicate with each of the pressure chambers 16 via individual flow paths 17*a* and 17*b*. In the present exemplary embodiment, the liquid flows from the common supply paths 18*a* and 18*b* into the pressure chamber 16 through the individual flow paths 17*a* and 17*b*. However, for example, a circulatory flow may be generated in liquid inside the pressure chamber 16. In other words, a circulatory flow allowing the liquid to flow from one common supply path 18*a* to the pressure chamber 16 via the individual flow path 17*a* and to flow into the other common supply path 18*b* via the individual flow path 17*b* may be formed. In such a case, a circulation path for allowing the liquid to be circulated between the liquid discharge head 1 and a liquid container arranged outside is formed in the liquid discharge head 1, and each of the common supply paths 18*a* and 18*b* functions as one portion of the circulation path so that the liquid inside the pressure chamber 16 is circulated between the liquid discharge head 1 and the outside unit.

In the example illustrated in FIG. 3B, the two common supply paths 18*a* and 18*b* are arranged with respect to the plurality of pressure chambers 16 of one discharge port array 12. Alternatively, one common supply path may be arranged. Moreover, the individual flow paths 17*a* and 17*b* are arranged between the pressure chamber 16 and the common supply paths 18*a* and 18*b*, respectively, in other words, only one individual flow path is arranged between the pressure chamber and the common supply path. Alternatively, two or more individual flow paths may be arranged.

Figure 4:
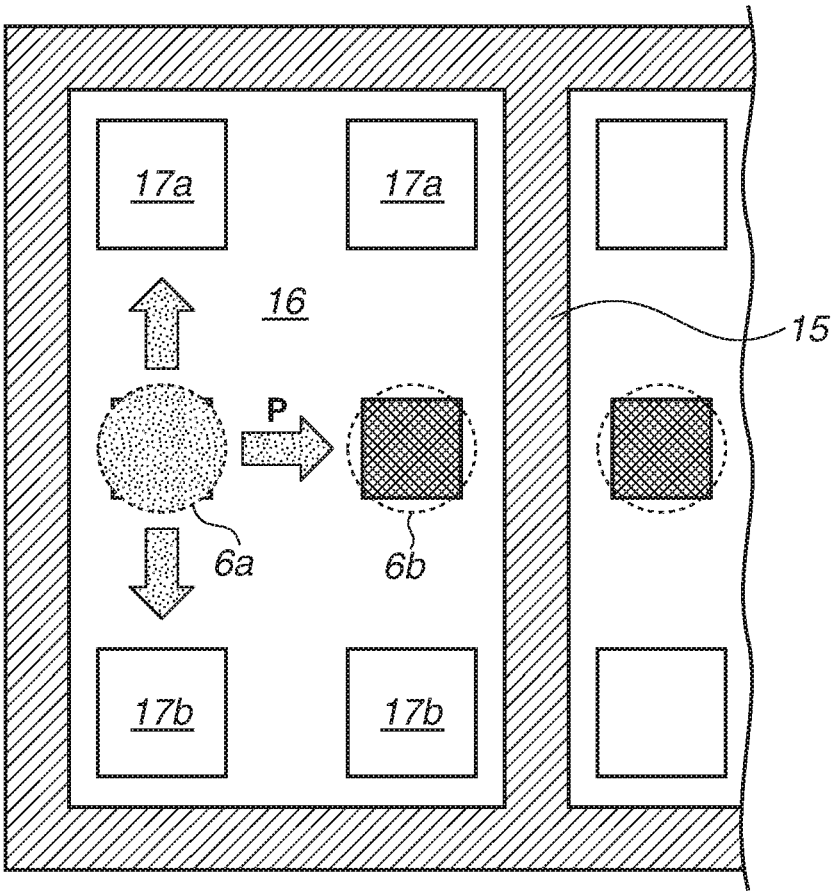
FIG. 4 is a diagram illustrating influence of crosstalk.

Reasons for reduction of influence of crosstalk by the configuration of the present exemplary embodiment are described with reference FIGS. 3C and 4. FIG. 4 is a schematic sectional view illustrating a configuration of a recording element board with one pressure chamber communicating with two discharge ports, instead of one pressure chamber communicating with one discharge port. FIG. 4 corresponds to FIG. 3C.

In the configuration illustrated in FIG. 4, when liquid is discharged from a discharge port 6*a* that is one of the two discharge ports 6*a* and 6*b* communicating with the one pressure chamber 16, pressure wave P is generated by bubble. The pressure wave P propagate through liquid. When the pressure wave P reaches the adjacent discharge port 6*b*, a change in an interface of the liquid in the discharge port 6*b* occurs. The interface of the liquid may be more raised or recessed than that in a normal state. If the liquid is discharged from the discharge port 6*b* while the interface of the liquid is being more raised, an amount of the liquid to be discharged increases. On the other hand, if the liquid is discharged from the discharge port 6*b* while the interface of the liquid is being more recessed, an amount of the liquid to be discharged decreases. Consequently, this causes an uneven amount of the liquid to land on the recording medium 2. Such unevenness appears as density unevenness on a recorded image, causing image quality degradation. The pressure wave P propagates to the individual flow paths 17*a* and 17*b*. However, the influence of crosstalk on the adjacent pressure chamber 16 from the individual flow paths 17*a* and 17*b* via the common supply paths 18*a* and 18*b* is negligibly small, since each of the common supply paths 18*a* and 18*b* extends in an array direction of the discharge port array 12 and has an area large enough to attenuate the pressure wave P.

On the other hand, in the configuration illustrated in FIG. 3C according to the present exemplary embodiment, the pressure chambers 16 are partitioned by the partition 15 in such a manner that each of the adjacent pressure chambers 16 communicates with the discharge port 6 on a one-to-one basis. Accordingly, the pressure wave P generated inside the pressure chamber 16 by drive of the energy generating element 14 is not transmitted to the adjacent pressure chamber 16. For this reason, the adjacent pressure chamber 16 is not affected. Therefore, each of the discharge ports 6 can discharge a desired amount of liquid to the recording medium 2. As a result, density unevenness of a recorded image can be reduced, and image quality degradation can be prevented.

Figure 5A:
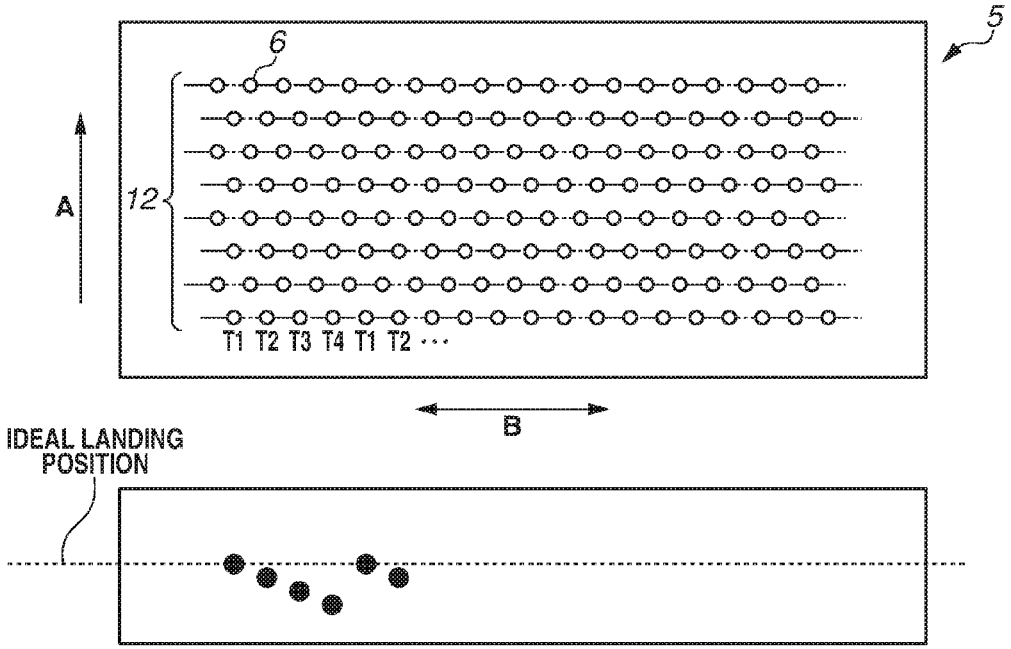
FIGS. 5A and 5B are diagrams each illustrating a relation between a discharge operation and discharge port arrangement.
Figure 5B:
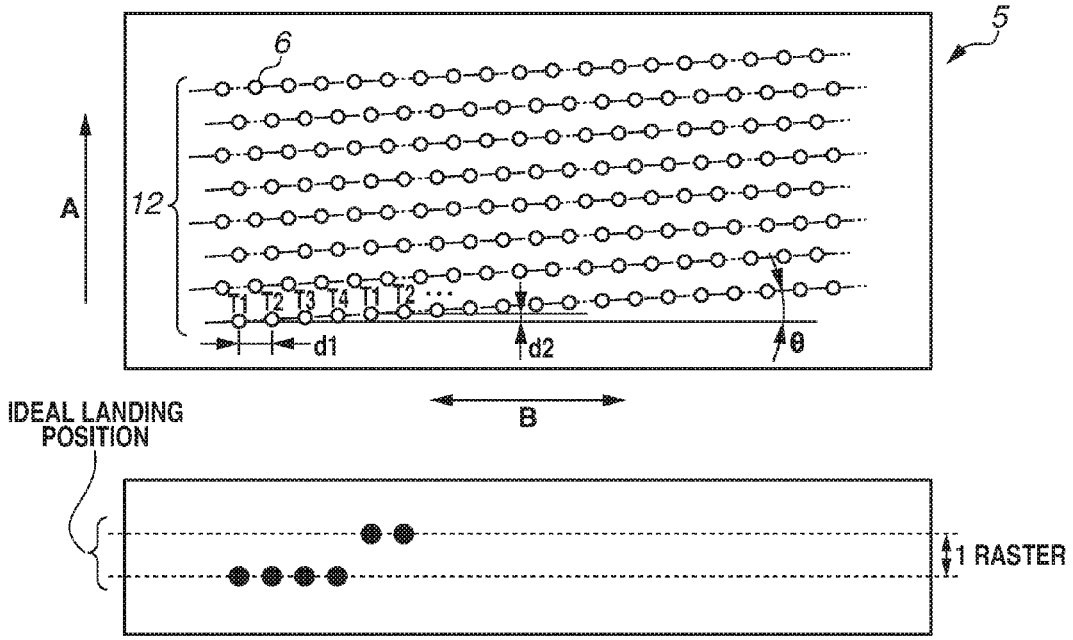

Next, a relation between a discharge operation and discharge port arrangement in the liquid discharge head according to the present exemplary embodiment is described with reference to FIGS. 5A and 5B. FIG. 5A includes a schematic plan view illustrating a recording element board with discharge port arrays arranged in a direction perpendicular to a conveyance direction of recording medium, and a diagram illustrating a state in which liquid has landed on the recording medium from the recording element board. FIG. 5B includes a schematic plan view illustrating a recording element board according to the present exemplary embodiment, and a diagram illustrating a state in which liquid has landed on a recording medium from the recording element board according to the present exemplary embodiment.

In a configuration illustrated in the upper diagram of FIG. 5A, it is desired that liquid is simultaneously discharged from all the discharge ports 6 in the same discharge port array 12 so that the liquid to be discharged from the same discharge port array 12 neatly lands at ideal landing positions on straight line perpendicular to the conveyance direction A. However, the simultaneous discharge of the liquid from all the discharge ports 6 may need large electric power or reduce a discharge frequency due to consumption of time for a liquid refill. For this reason, the simultaneously discharge is difficult.

Such a problem may be dealt with by dividing the plurality of discharge ports within the discharge port array 12 into plurality of groups, so that liquid discharge operation can be sequentially performed on a group basis according to time division. In this discharge operation, for example, the plurality of discharge ports 6 within the discharge port array 12 is divided into four groups of every fourth discharge port (i.e., every four discharge ports). Then, liquid is discharged from all of the discharge ports 6 belonging to a first group at a first discharge timing T1. Subsequently, liquid is discharged from all of the discharge ports 6 respectively belonging to a second group at a second discharge timing T2, a third group at a third discharge timing T3, and a fourth group at a fourth discharge timing T4. In this way, each of the plurality of discharge ports 6 in the same group discharges liquid at a same time, and a plurality of discharge ports 6 in different groups successively discharges liquid. Such a drive method like this is referred to as "time divisional driving". The time divisional driving can save the electric power necessary for a discharge operation, and enables discharge to be performed at a higher frequency by reducing time consumed for a liquid refill.

However, as illustrated in the lower diagram of FIG. 5A, the method for shifting a discharge timing on a group basis causes a liquid landing position on the recording medium 2 to be misaligned in the conveyance direction A from an ideal landing position. This degrades image quality.

According to the present exemplary embodiment, an amount of misalignment of a landing position in the conveyance direction A is assumed beforehand based on a conveyance speed of recording medium or a discharge frequency. Then, the discharge port arrays 12 are inclined to the head longitudinal direction B by an angle θ corresponding to the misalignment amount as illustrated in the upper diagram of FIG. 5B. This cancels the misalignment of the landing position due to the time divisional driving. As a result, liquid can neatly land on a straight line parallel to the head longitudinal direction B, and image quality degradation can be prevented.

The inclination angle θ satisfies a relation of $\tan\theta = d2/(N \times d1)$, where N is the number of groups into which the discharge ports 6 within the discharge port array 12 are divided (N≥2), d1 is a distance between the discharge ports 6 within the discharge port array 12 in the head longitudinal direction B, and d2 is a distance between adjacent discharge ports within the same group in the conveyance direction A. In this case, the liquid discharged from the discharge ports 6, which perform discharge operations at the same time (e.g., at a discharge timing T1), within the same group lands on the recording medium 2 with misalignment by 1 raster in the conveyance direction A as illustrated in the lower diagram of FIG. 5B. For this reason, an image can be recorded while resolution necessary with respect to the conveyance direction A of the recording medium 2 is being retained, and image quality degradation can be prevented. In the present exemplary embodiment, the inclination angle θ is calculated from N=4, d1=42.3 μm (600 dpi), and d2=21.2 μm (1200 dpi). These numeric values are merely examples, and various values can be applied according to specifications or necessary capability of the liquid discharge head.

In the present exemplary embodiment, the rectangular recording element board 5 is arranged parallel to the head longitudinal direction B, and the discharge port array 12 is arrayed in an inclined manner with respect to a longitudinal direction of the recording element board 5. In this way, the discharge port array 12 is arrayed in the inclined manner with respect to the head longitudinal direction B perpendicular to the conveyance direction A of the recording medium 2. However, such a method for inclining the discharge port array 12 to the head longitudinal direction B is not limited thereto. For example, the rectangular recording element board 5 may be arranged so as to be inclined to the head longitudinal direction B, and the discharge port array 12 may be arrayed parallel to a longitudinal direction of the rectangular recording element board 5.

A method called distributed driving may be used as a time divisional driving method. The distributed driving method randomly distributes and drives a plurality of discharge ports 6 belonging to different groups to discharge liquid, instead of discharging liquid in an array order as described in the present exemplary embodiment. However, if the distributed driving is employed, positions of the discharge ports 6 need to be changed according to an actual discharge order to correct misalignment of liquid landing positions. As a result, the discharge ports 6 are irregularly arranged, and it is difficult to arrange the common supply paths 18*a* and 18*b* or the individual flow paths 17*a* and 17*b*. On the other hand, if a sequential driving such as the method used in the present exemplary embodiment is employed, the discharge port array 12 or the recording element board 5 only needs to be inclined as described above to correct misalignment of a liquid landing position. Thus, it is easy to arrange the common supply paths 18*a* and 18*b* or the individual flow paths 17*a* and 17*b*. Therefore, the sequential driving used in the present exemplary embodiment is preferred as the time divisional driving method.

In the present exemplary embodiment, all of the discharge ports 6 within the discharge port array 12 are spaced at equal intervals so that resolution in the head longitudinal direction B is uniform. In this case, discharge timings T1 through T4 are preferably set at equal intervals. In this manner, image recording can be uniformly performed in the conveyance direction A of the recording medium 2 and the head longitudinal direction B, and image quality degradation can be prevented.

Figure 6A:
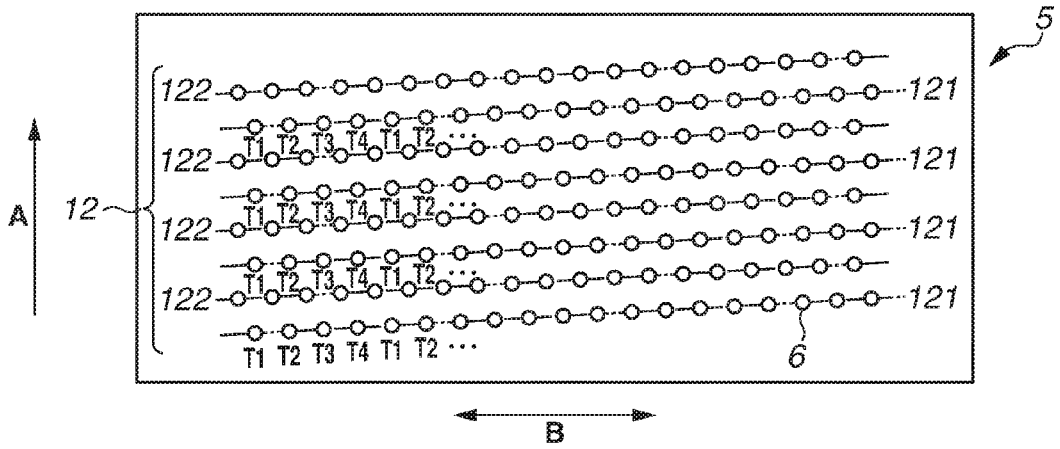
FIG. 6A is a schematic plan view illustrating a recording element board according to a second exemplary embodiment.
Figure 6B:
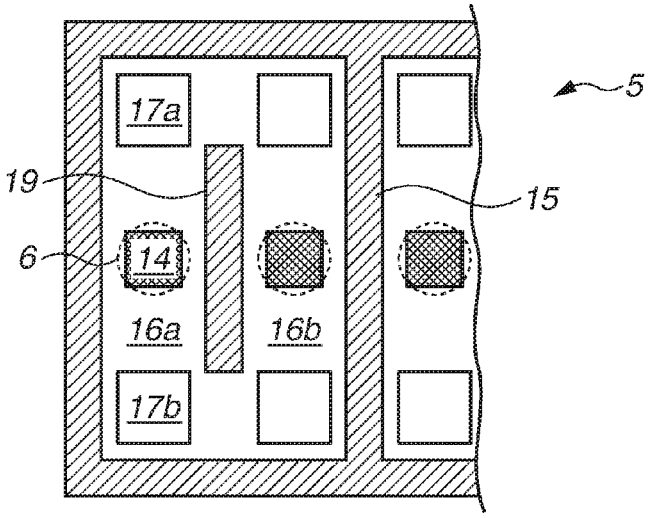
FIGS. 6B and 6C are sectional views each illustrating the recording element board.
Figure 6C:
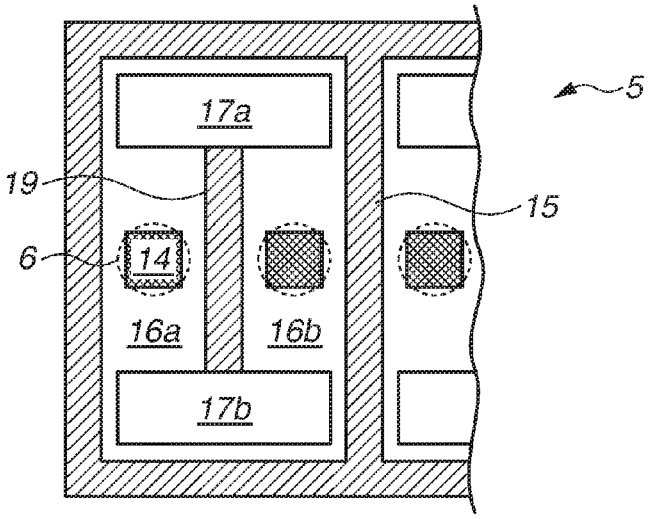

A configuration of a liquid discharge head according to a second exemplary embodiment is described with reference to FIGS. 6A, 6B, and 6C. FIG. 6A is a schematic plan view illustrating the recording element board 5 according to the present exemplary embodiment. FIGS. 6B and 6C are schematic sectional views each illustrating the recording element board 5 and corresponding to the diagram illustrated in FIG. 3C.

As illustrated in FIG. 6A, a configuration of a discharge ports 6 of the present exemplary embodiment is similar to that of the discharge ports 6 of the first exemplary embodiment. However, as illustrated in FIGS. 6B and 6C, a configuration of each of pressure chambers 16*a* and 16*b* of the present exemplary embodiment is different from that of the pressure chamber 16 of the first exemplary embodiment. Specifically, in the present exemplary embodiment, the two adjacent pressure chambers 16*a* and 16*b* in each discharge port array 12 communicate with each other by being partially partitioned by a second partition 19. Such arrangement differs from the first exemplary embodiment. By virtue of the arrangement, for example, even if a foreign substance enters liquid and one pressure chamber 16*a* is clogged with the foreign substance, the liquid can be discharged from the two discharge ports 6 through the other pressure chamber 16*b*. Individual flow paths 17*a* and 17*b* may be arranged with respect to two discharge ports 6 of the two pressure chambers 16*a* and 16*b* communicating with each other, in other words, four individual flow paths may be arranged as illustrated in FIG. 6B. Alternatively, two individual flow paths may be arranged as illustrated in FIG. 6C. The configuration illustrated in FIG. 6C has advantages in supplying liquid since not only clogging due to a foreign substance in the liquid is further prevented, but also liquid resistance of the flow path is reduced. Examples of configurations of two or four individual flow paths are described for the purpose of explaining the effects. However, sizes and the number of individual flow paths are not limited to specific values.

In the present exemplary embodiment, the two adjacent pressure chambers 16*a* and 16*b* in each discharge port array 12 communicate with each other. However, three or more successive pressure chambers in an array direction of each discharge port array 12 may communicate with one another.

Since the configuration of the pressure chamber according to the present exemplary embodiment differs from that of the pressure chamber 16 according to the first exemplary embodiment, a liquid discharge operation according to time divisional driving also differs from that of the first exemplary embodiment. The discharge operation performed with the liquid discharge head according to the present exemplary embodiment is described below with reference to FIGS. 6A, 7A, 7B, 7C, and 7D. FIGS. 7A through 7D are plan views of the liquid discharge heads illustrating the discharge operation according to the present exemplary embodiment.

In the present exemplary embodiment, since the adjacent pressure chambers 16*a* and 16*b* in each discharge port array 12 communicate with each other, there is influence of crosstalk as described above with reference to FIG. 4. In the present exemplary embodiment, a series of discharge operations is separately performed by discharge port array groups 121 and 122 including a plurality of discharge port arrays 12 in such a manner that two discharge ports 6 communicating via the pressure chambers 16*a* and 16*b* do not successively discharge liquid. Each of the discharge port array groups 121 and 122, as illustrated in FIG. 6A, includes a plurality of discharge port arrays 12 with the discharge ports 6 arranged at substantially the same positions in a head longitudinal direction B. The discharge operation performed by the discharge port array group 121 is described below.

Figure 7A:
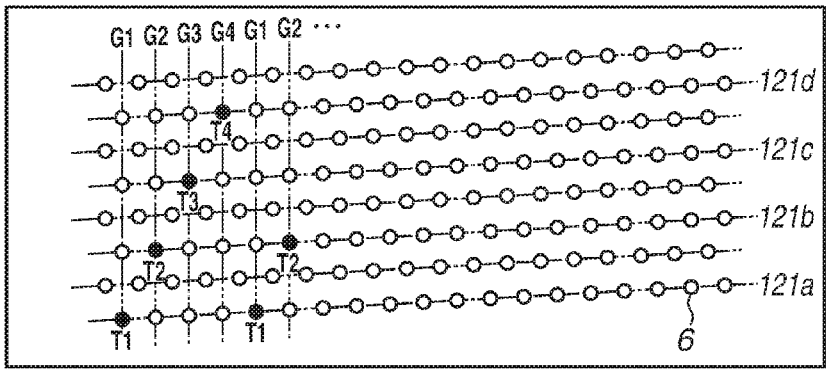
FIGS. 7A to 7D are diagrams illustrating discharge operations according to the second exemplary embodiment.
Figure 7B:
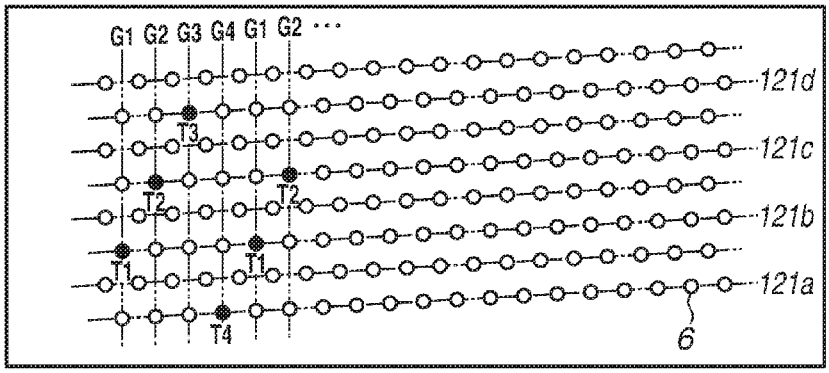
Figure 7C:
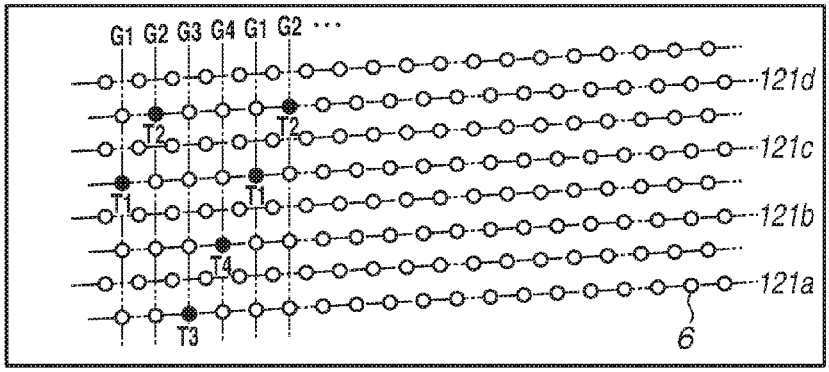
Figure 7D:
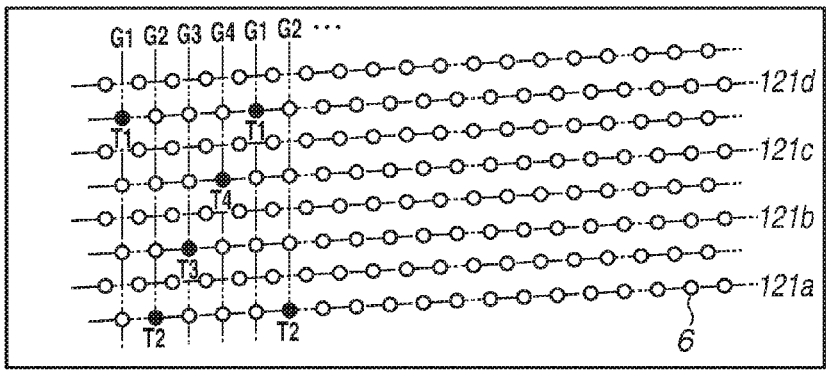

In the present exemplary embodiment, as illustrated in FIGS. 7A through 7D, the discharge port array group 121 is divided into four groups G1 through G4. In the same discharge port array, each of the groups G1 through G4 includes a plurality of discharge ports arranged every fourth discharge port (i.e., every four discharge ports). In different discharge port arrays, each of the groups G1 through G4 includes a plurality of discharge ports 6 arranged at substantially the same positions in the head longitudinal direction B. First, a discharge operation as illustrated in FIG. 7A is executed. Specifically, liquid is discharged from discharge ports belonging to the first group G1 in a first discharge port array 121*a* at a first discharge timing T1, and liquid is discharged from discharge ports 6 belonging to the second group G2 in a second discharge port array 121*b* at a second discharge timing T2. Then, liquid is discharged from discharge ports 6 belonging to the third group G3 in a third discharge port array 121*c* at a third discharge timing T3, and liquid is discharged from discharge ports belonging to the fourth group G4 in a fourth discharge port array 121*d* at a fourth discharge timing T4. Subsequently, discharge operations illustrated in FIGS. 7B, 7C, and 7D are executed as similar to the procedure performed in FIG. 7A. Then, the discharge operation illustrated in FIG. 7A is executed again.

With such discharge operations, two discharge ports 6 communicating with each other via the pressure chambers 16*a* and 16*b* within the same discharge port array cannot successively discharge liquid. As a result, the influence of crosstalk can be prevented inside the pressure chambers 16*a* and 16*b* communicating with each other, thereby preventing image quality degradation.

In the present exemplary embodiment, the plurality of discharge ports 6 in the different discharge port arrays 121*a* through 121*d* successively discharges liquid in array order in the head longitudinal direction B. However, the liquid discharge order is not limited thereto. The discharge port array group 121 as a whole including the four discharge port arrays 121*a* through 121*d* may be sequentially driven, in other words, a plurality of discharge ports belonging to different groups in different discharge port arrays 121*a* through 121*d* may sequentially discharge liquid. Therefore, the liquid discharge order may not necessarily be the array order of the discharge ports 6 in the head longitudinal direction B. Moreover, in the present exemplary embodiment, the discharge operations are executed as illustrated in FIGS. 7A, 7B, 7C, and 7D in this order. However, such order can be changed. Alternatively, for example, only the discharge operation illustrated in FIG. 7A may be executed.

In the present exemplary embodiment, a series of discharge operations is performed by the discharge port array group 121 including the four discharge port arrays 121*a* through 121*d* so that liquid is not successively discharged from the two pressure chambers 16*a* and 16*b* communicating with each other. However, it should be noted that the number of discharge port arrays necessary to obtain the effects of the present exemplary embodiment is determined depending on the number of pressure chambers communicating with each other and the number of groups (the number of time divisions) each including a plurality of discharge ports. In other words, when the number of pressure chambers communicating with each other is M (where M≥2) and the number of groups (the number of time divisions) is N (where N≥2), if N≥M, the number of necessary discharge port arrays is at least M. If M≥N, the number of necessary discharge port arrays is at least N. Accordingly, the discharge port array group including such number of discharge port arrays performs a series of the above-described discharge operations, so that liquid can be prevented from being successively discharged from the M number of the discharge ports of the M number of successive pressure chambers in each discharge port array.

Figure 8A:
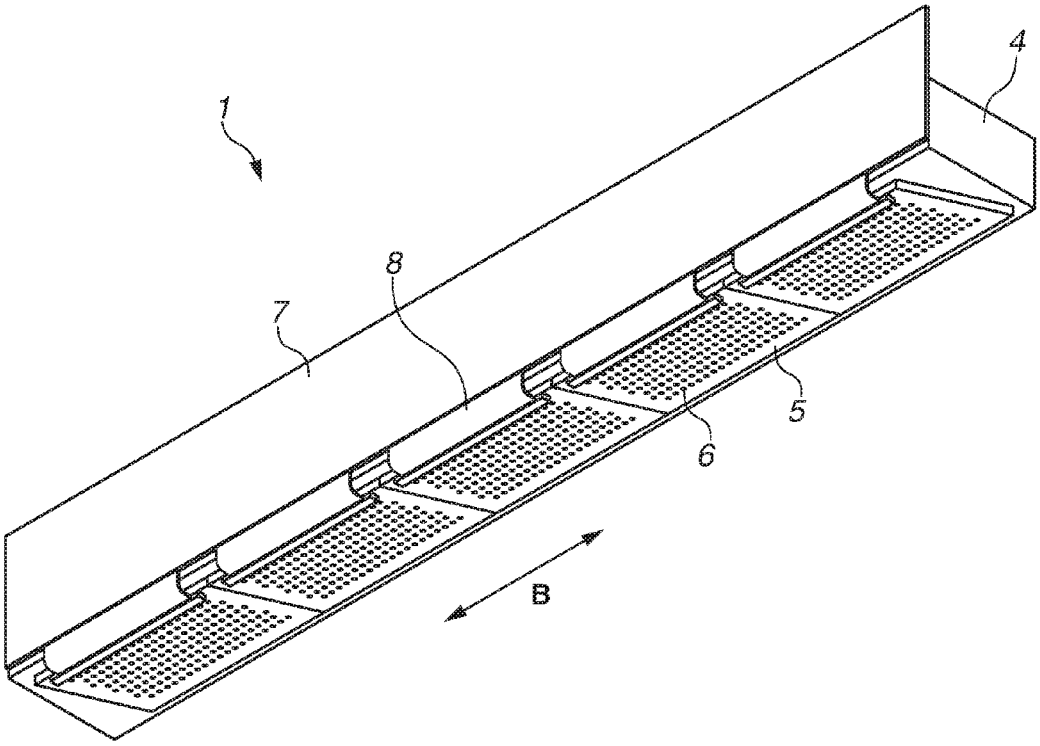
FIGS. 8A and 8B are schematic diagrams illustrating liquid discharge head and recording element board, respectively, according to a third exemplary embodiment.
Figure 8B:
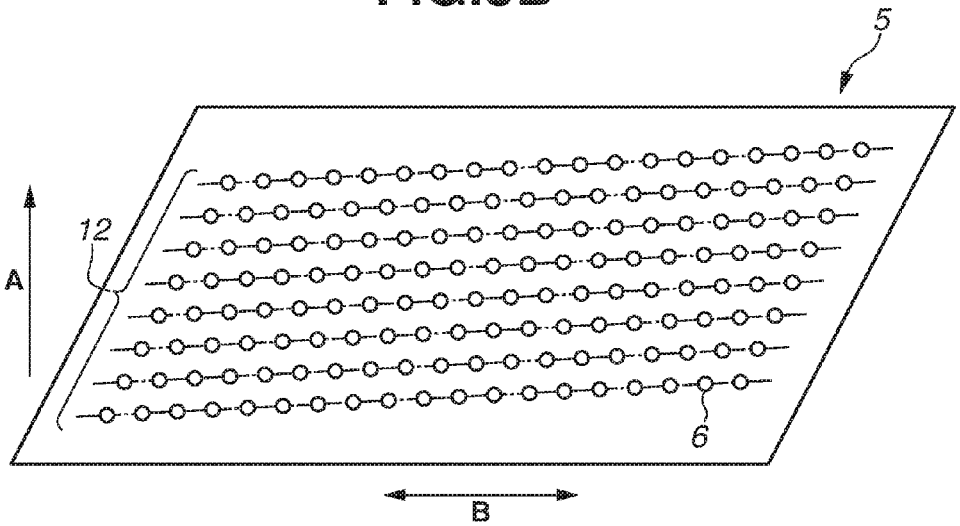

A configuration of a liquid discharge head according to a third exemplary embodiment is described with reference to FIGS. 8A and 8B. FIG. 8A is a schematic perspective view of the liquid discharge head according to the present exemplary embodiment, and FIG. 8B is a schematic plan view of a recording element board according to the present exemplary embodiment.

In the present exemplary embodiment, a planar shape of the recording element board 5 is different from that described in the above exemplary embodiments. Specifically, a planar shape of the recording element board according to the above exemplary embodiments is a rectangle, whereas a planar shape of the recording element board 5 according to the present exemplary embodiment is parallelogram. Other configurations are similar to those of the above exemplary embodiments. Therefore, the present exemplary embodiment is also expected to sufficiently contribute to an effect of reducing influence of crosstalk.

Figure 9A:
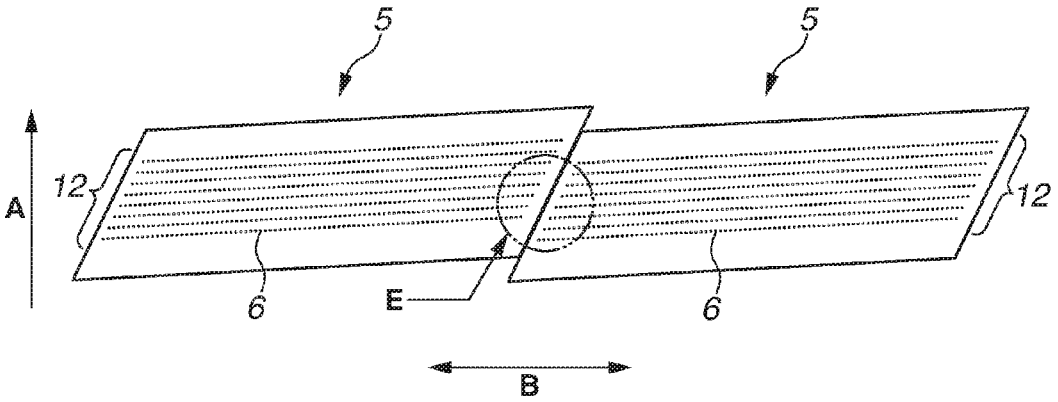
FIGS. 9A and 9B are schematic plan views each illustrating the recording element boards according to the third exemplary embodiment.
Figure 9B:
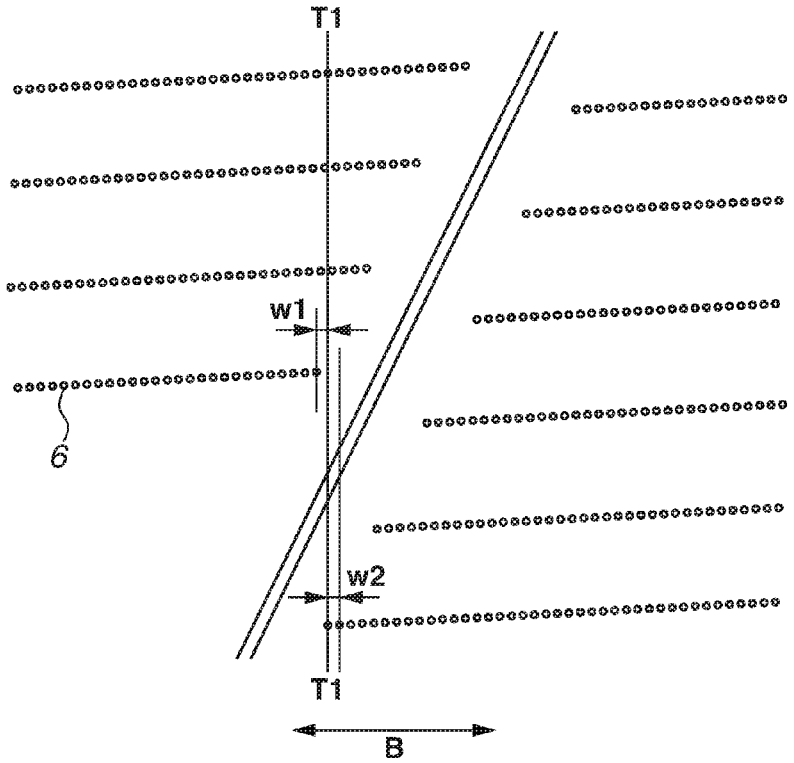

Meanwhile, there is a case that a discharge port cannot be formed in a predetermined area in an end portion of the recording element board 5 to maintain strength of the recording element board 5 or provide an area in which a component such as wiring is mounted. In such a case, if the recording element boards 5 are arranged side by side in a line in such a manner that a longitudinal direction of the recording element boards 5 is parallel to a head longitudinal direction B, an area in which a discharge port 6 is not arranged in the head longitudinal direction B is generated, causing degrade image quality. On the other hand, the recording element boards 5 may be arranged in such a manner that the longitudinal direction of the recording element boards 5 is inclined to the head longitudinal direction B. The enables discharge ports 6 that discharge liquid having the same lightness of color to align in the head longitudinal direction B in the adjacent recording element boards 5, thereby preventing image quality degradation. Specific arrangement of such recording element boards 5 is described below with reference to FIGS. 9A and 9B. FIG. 9A is a schematic plan view of two adjacent recording element boards 5, and FIG. 9B is an enlarged plan view of an area indicated by a circle E shown in FIG. 9A. Although a shape of the recording element board 5 illustrated in FIGS. 9A and 9B differs from that of the recording element board 5 illustrated in FIGS. 8A and 8B, the arrangement illustrated in FIGS. 9A and 9B can be applied to the recording element board 5 illustrated in FIGS. 8A and 8B.

The recording element board 5 illustrated in FIG. 9A includes eight discharge port arrays 12, and one discharge port group is formed of the two discharge port arrays 12. As illustrated in FIG. 9B, in the head longitudinal direction B, width w1 between discharge ports 6 belonging to the same discharge port array 12 on one of two adjacent recording element boards 5 is preferably the same as width w2 between discharge ports 6 belonging to the same discharge port array 12 on the other recording element board 5. Such arrangement enables an image to be recorded even between the two adjacent recording element boards 5 with quality similar to that acquired using the single recording element board 5. Moreover, as illustrated in FIG. 9B, in the present exemplary embodiment, it is preferable that liquid is discharged at a same discharge timing (T1) from discharge ports 6 arranged at substantially the same positions in the head longitudinal direction B on the adjacent recording element boards 5 discharge timing. In this manner, liquid landing positions according to time divisional driving are not misaligned even between the two adjacent recording element boards thereby preventing image quality degradation.

Figure 10:
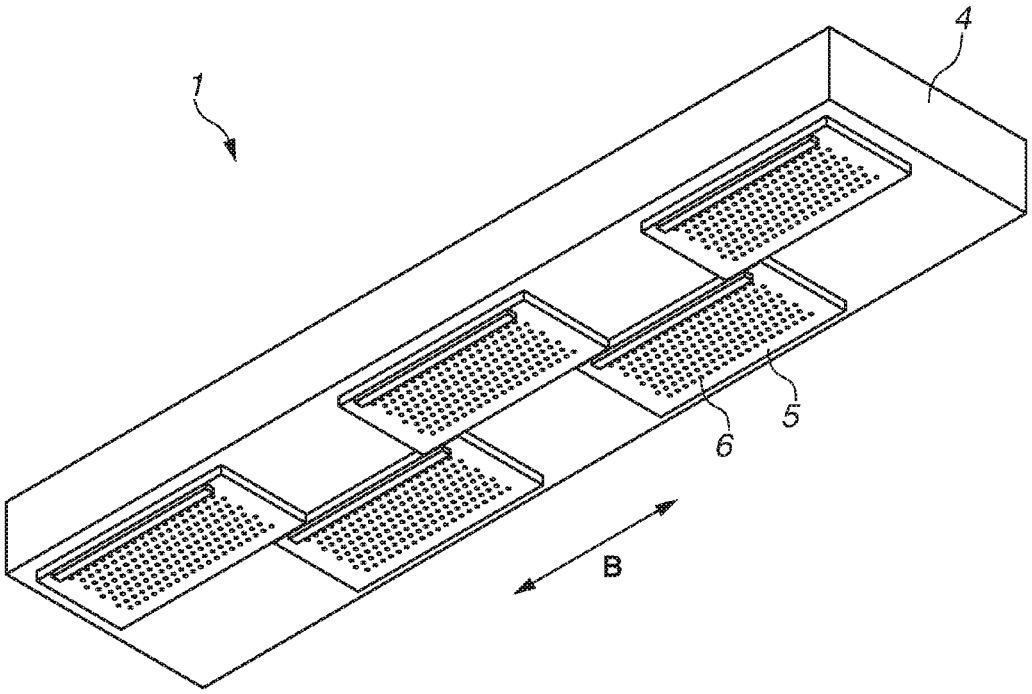
FIG. 10 is a schematic perspective view illustrating a liquid discharge head according to a fourth exemplary embodiment.

A configuration of a liquid discharge head according to a fourth exemplary embodiment is described. FIG. 10 is a schematic perspective view illustrating the liquid discharge head according to the present exemplary embodiment.

As described above, there is a case that a discharge port 6 cannot be formed in a predetermined area in an end portion of a recording element board 5 to maintain strength of the recording element board 5 or provide an area in which a component such as wiring is mounted. In such a case, arrangement of the recording element boards 5 side by side in a line in a head longitudinal direction B may generate an area in which a discharge port 6 is not arranged in the head longitudinal direction B, causing image quality degradation. The present exemplary embodiment prevents the image quality degradation that may be caused as above. In the present exemplary embodiment, the recording element boards 5 are arranged in a staggered pattern as illustrated in FIG. 10, instead of being arranged side by side in a line in the head longitudinal direction B as described in the above exemplary embodiments. In this manner, the discharge ports 6 can be evenly arranged in the head longitudinal direction B, and image quality degradation can be prevented. Since other configurations are substantially the same as those described in each of the first and second exemplary embodiments, the present exemplary embodiment is also expected to sufficiently contribute to an effect of reducing influence of crosstalk.

The liquid discharge head according to the exemplary embodiments of the present disclosure can reduce the influence of crosstalk to provide higher image quality.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-170768, filed Sep. 1, 2016, which is hereby incorporated by reference herein in its entirety.

What is claimed is:

1. A liquid discharge head configured to discharges liquid to a recording medium conveyed in a first direction, the liquid discharge head comprising:

a recording element board including:

a plurality of discharge ports for discharging liquid;

a plurality of pressure chambers communicating with the plurality of discharge ports, respectively, and each including thereinside an energy generating element configured to generate energy to be used for discharging liquid; and a common supply path communicating with the plurality of pressure chambers and configured to supply liquid to the plurality of pressure chambers, wherein the plurality of discharge ports forms a discharge port array arrayed in an inclined manner with respect to a second direction perpendicular to the first direction, wherein adjacent pressure chambers in an array direction of the discharge port array communicate with each other via only the common supply path, wherein the plurality of discharge ports is divided into N number of groups (N≥2), each of the groups includes a plurality of discharge ports arranged every Nth discharge port, and the N number of groups sequentially perform liquid discharge operations on a group basis according to time division in such a manner that each of a plurality of discharge ports belonging to a same group discharges liquid at a same time and a plurality of discharge ports belonging to different groups successively discharges liquid in array order, and wherein the discharge port array is inclined to the second direction by an angle θ that satisfies a relation of $\tan\theta = d2/(N \times d1)$, where d1 is a distance between discharge ports within the discharge port array in the second direction, and d2 is a distance between two adjacent discharge ports within each of the groups in the first direction.

2. The liquid discharge head according to claim 1, comprising a plurality of the recording element boards arranged side by side in a line in the second direction.

3. The liquid discharge head according to claim 2, wherein the recording element board is a parallelogram in planar shape.

4. The liquid discharge head according to claim 3, wherein the plurality of recording element boards is arranged in such a manner that a distance between adjacent discharge ports on one recording element board in the second direction substantially same as a distance between discharge ports within the discharge port array on the adjacent recording element boards in the second direction.

5. The liquid discharge head according to claim 4, wherein liquid is discharged at a same time from discharge ports arranged at same positions in the second direction on the adjacent recording element boards.

6. The liquid discharge head according to claim 1, further comprising a plurality of the recording element boards arranged in a staggered pattern in the second direction.

7. The liquid discharge head according to claim 1, wherein the recording element board is arranged in such a manner that a longitudinal direction thereof is parallel to the second direction, and the discharge port array is arrayed in an inclined manner with respect to the longitudinal direction of the recording element board.

8. The liquid discharge head according to claim 1, wherein the recording element board is arranged in such a manner that a longitudinal direction thereof is inclined to the second direction, and the discharge port array is arrayed parallel to the longitudinal direction of the recording element board.

9. The liquid discharge head according to claim 1, wherein the plurality of discharge ports is arranged across a width direction of the recording element board.

10. The liquid discharge head according to claim 1, wherein liquid inside the pressure chambers is circulated and from an external unit.

11. A liquid discharge head configured to discharges liquid to a recording medium conveyed in a first direction, the liquid discharge head comprising:

a recording element board including:

a plurality of discharge ports for discharging liquid;

a plurality of pressure chambers communicating with the plurality of discharge ports, respectively, and each including thereinside an energy generating element configured to generate energy to be used for discharging the liquid; and a common supply path communicating with the plurality of pressure chambers and configured to supply liquid to the plurality of pressure chambers, wherein the plurality of discharge ports forms a plurality of parallel discharge port arrays arrayed in an inclined manner with respect to a second direction perpendicular to the first direction, wherein at least some of M number of successive pressure chambers ($M \geq 2$) in an array direction of each of the discharge port arrays communicate with each other, wherein the plurality of discharge ports is divided into N number of groups ($N \geq 2$), each of the groups includes a plurality of discharge ports arranged every Nth discharge port in a same discharge port array and a plurality of discharge ports arranged at same positions in the second direction in different discharge port arrays, and the N number of groups sequentially perform liquid discharge operations on a group basis according to time division in such a manner that a plurality of discharge ports belonging to a same group in a same discharge port array discharges liquid at a same time and a plurality of discharge ports belonging to different groups in different discharge port arrays successively discharges liquid, wherein the plurality of discharge ports forms at least M number of the discharge port arrays if N is equal to or larger than M ($N \geq M$), and forms at least N number of the discharge port arrays if M is larger than N ($M > N$), and wherein each of the discharge port arrays is inclined to the second direction by an angle θ that satisfies a relation of $\tan \theta = d2/(N \times d1)$, where d1 is a distance between discharge ports within each of the discharge port arrays in the second direction, and d2 is a distance between two adjacent discharge ports within each of the groups in the first direction.

* * * * *